US011500326B2

(12) United States Patent
Taguchi et al.

(10) Patent No.: US 11,500,326 B2
(45) Date of Patent: Nov. 15, 2022

(54) IMAGE FORMING APPARATUS INCLUDING DRUM CARTRIDGE AND DEVELOPMENT CARTRIDGE

(71) Applicant: BROTHER KOGYO KABUSHIKI KAISHA, Nagoya (JP)

(72) Inventors: Kazuna Taguchi, Nagoya (JP); Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/349,325

(22) Filed: Jun. 16, 2021

(65) Prior Publication Data

US 2021/0405579 A1 Dec. 30, 2021

(30) Foreign Application Priority Data

Jun. 30, 2020 (JP) ..... JP2020-113254

(51) Int. Cl.
*G03G 21/18* (2006.01)
*G03G 21/16* (2006.01)

(52) U.S. Cl.
CPC ..... *G03G 21/1821* (2013.01); *G03G 21/1633* (2013.01); *G03G 21/1647* (2013.01); *G03G 21/1814* (2013.01); *G03G 21/1842* (2013.01); *G03G 2221/1869* (2013.01)

(58) Field of Classification Search
CPC ..... G03G 21/1821; G03G 21/1633; G03G 21/1647; G03G 21/1814; G03G 21/1842; G03G 2221/1869
See application file for complete search history.

(56) References Cited

U.S. PATENT DOCUMENTS

2010/0080624 A1* 4/2010 Matsuda ..... G03G 21/1853 399/119
2011/0103844 A1 5/2011 Sato
2011/0299873 A1 12/2011 Ushiozu et al.
2013/0164027 A1 6/2013 Sato et al.
(Continued)

FOREIGN PATENT DOCUMENTS

JP 2011-95578 A 5/2011
JP 2013-134370 A 7/2013
(Continued)

*Primary Examiner* — Sandra Brase
(74) *Attorney, Agent, or Firm* — Merchant & Gould P.C.

(57) ABSTRACT

One of two walls apart from each other in a first direction has an opening. A drum cartridge includes a photosensitive drum rotatable about a drum axis extending in the first direction when the drum cartridge is attached to a housing. The drum cartridge is movable through the opening between a first position at which an entirety of the drum cartridge is located inside the housing and a second position at which at least part of the drum cartridge is located outside the housing. The development cartridge includes a development roller rotatable about an axis extending in the first direction. The development cartridge is unattachable to and undetachable from the drum cartridge in a state where the drum cartridge is located at the first position. The development cartridge is attachable to and detachable from the drum cartridge in a state where the drum cartridge is located at the second position.

24 Claims, 8 Drawing Sheets

(56) References Cited

U.S. PATENT DOCUMENTS

| | | | | |
|---|---|---|---|---|
| 2013/0164032 | A1 | 6/2013 | Sato et al. | |
| 2013/0243476 | A1 | 9/2013 | Sato | |
| 2015/0346679 | A1 | 12/2015 | Kusano et al. | |
| 2016/0291537 | A1 | 10/2016 | Sato | |
| 2017/0160697 | A1* | 6/2017 | Sato | G03G 21/1633 |
| 2017/0261925 | A1 | 9/2017 | Komatsu et al. | |

FOREIGN PATENT DOCUMENTS

| | | | |
|---|---|---|---|
| JP | 2013-182037 | A | 9/2013 |
| JP | 2013-195541 | A | 9/2013 |
| JP | 2013-195543 | A | 9/2013 |
| JP | 2014-186346 | A | 10/2014 |
| JP | 2016-6490 | A | 1/2016 |
| JP | 2016-191732 | A | 11/2016 |
| JP | 2017-161711 | A | 9/2017 |
| JP | 2018-49200 | A | 3/2018 |
| JP | 2018-136580 | A | 8/2018 |

* cited by examiner

IMAGE FORMING APPARATUS INCLUDING DRUM CARTRIDGE AND DEVELOPMENT CARTRIDGE

CROSS REFERENCE TO RELATED APPLICATIONS

This application claims priority from Japanese Patent Application No. 2020-113254 filed Jun. 30, 2020. The entire content of the priority application is incorporated herein by reference.

TECHNICAL FIELD

This disclosure relates to an image forming apparatus.

BACKGROUND

Conventionally, an image forming apparatus includes a housing and a process cartridge. The process cartridge contains toner. The process cartridge includes a photosensitive drum and a development roller. The photosensitive drum is rotatable about an axis extending in a first direction. The process cartridge is movable in the first direction between a first position located inside the housing and a second position located outside the housing.

SUMMARY

According to one aspect, this specification discloses an image forming apparatus. The image forming apparatus includes a housing, a drum cartridge, and a development cartridge. The housing has two walls apart from each other in a first direction. One of the two walls has an opening. The drum cartridge includes a photosensitive drum rotatable about a drum axis. The drum axis extends in the first direction in a state where the drum cartridge is attached to the housing. The drum cartridge is movable through the opening between a first position at which an entirety of the drum cartridge is located inside the housing and a second position at which at least part of the drum cartridge is located outside the housing. The development cartridge includes a development roller rotatable about a development roller axis extending in the first direction. The development cartridge is unattachable to and undetachable from the drum cartridge in a state where the drum cartridge is located at the first position. The development cartridge is attachable to and detachable from the drum cartridge in a state where the drum cartridge is located at the second position.

According to another aspect, this specification also discloses an image forming apparatus. The image forming apparatus includes a housing, a drum cartridge, and a development cartridge. The housing has an opening. The drum cartridge includes a photosensitive drum rotatable about a drum axis extending in a first direction. The drum cartridge is movable in the first direction through the opening between a first position at which an entirety of the drum cartridge is located inside the housing and a second position at which at least part of the drum cartridge is located outside the housing. The development cartridge includes a development roller rotatable about a development roller axis extending in the first direction. The development cartridge is unattachable to and undetachable from the drum cartridge in a state where the drum cartridge is located at the first position. The development cartridge is attachable to and detachable from the drum cartridge in a state where the drum cartridge is located at the second position.

BRIEF DESCRIPTION OF THE DRAWINGS

Embodiments in accordance with this disclosure will be described in detail with reference to the following figures wherein.

DETAILED DESCRIPTION

In the above image forming apparatus, when the development roller needs to be replaced, the entire process cartridge including the photosensitive drum needs to be replaced even through the photosensitive drum does not need to be replaced. With such an image forming apparatus, it is difficult to reduce the usage cost.

Thus, it is considered to separate the process cartridge into a development cartridge including a development roller and a drum cartridge including a photosensitive drum, and to replace the development cartridge and the drum cartridge individually.

However, if the development cartridge and the drum cartridge are separated, when replacing either one of the development cartridge and the drum cartridge, a user needs to determine the cartridge to be replaced and pull the cartridge out of the housing in a state where the development cartridge and the drum cartridge are located in the housing. Thus, the replacement work of the development cartridge or the drum cartridge may become complicated.

In view of the foregoing, an aspect of an objective of this disclosure is to provide an image forming apparatus in which a development cartridge and a drum cartridge can be replaced individually and smoothly.

1. 1. Image Forming Apparatus 1

An image forming apparatus 1 will be described with reference to FIGS. 1 to 5.

Figure 1:
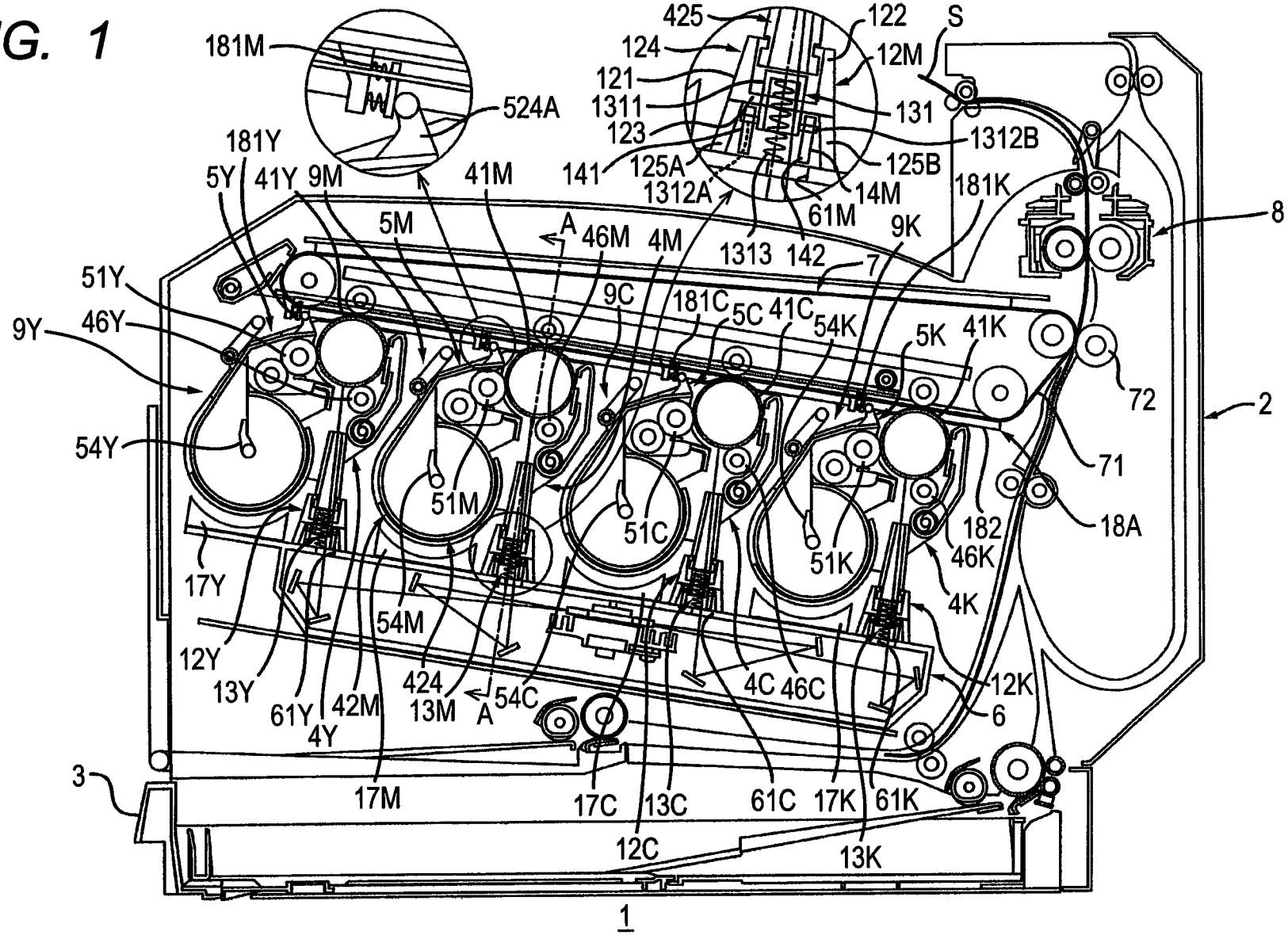
FIG. 1 shows a schematic configuration of an image forming apparatus.

As shown in FIG. 1, the image forming apparatus 1 includes a housing 2, a cover 10 (see FIG. 2), a sheet cassette 3, four process cartridges 9Y, 9M, 9C, 9K, an exposure device 6, a transfer device 7, and a fixing device 8.

1.1 Housing 2

The housing 2 accommodates the sheet cassette 3, the four process cartridges 9Y, 9M, 9C, 9K, the exposure device 6, the transfer device 7, and the fixing device 8.

Figure 2:
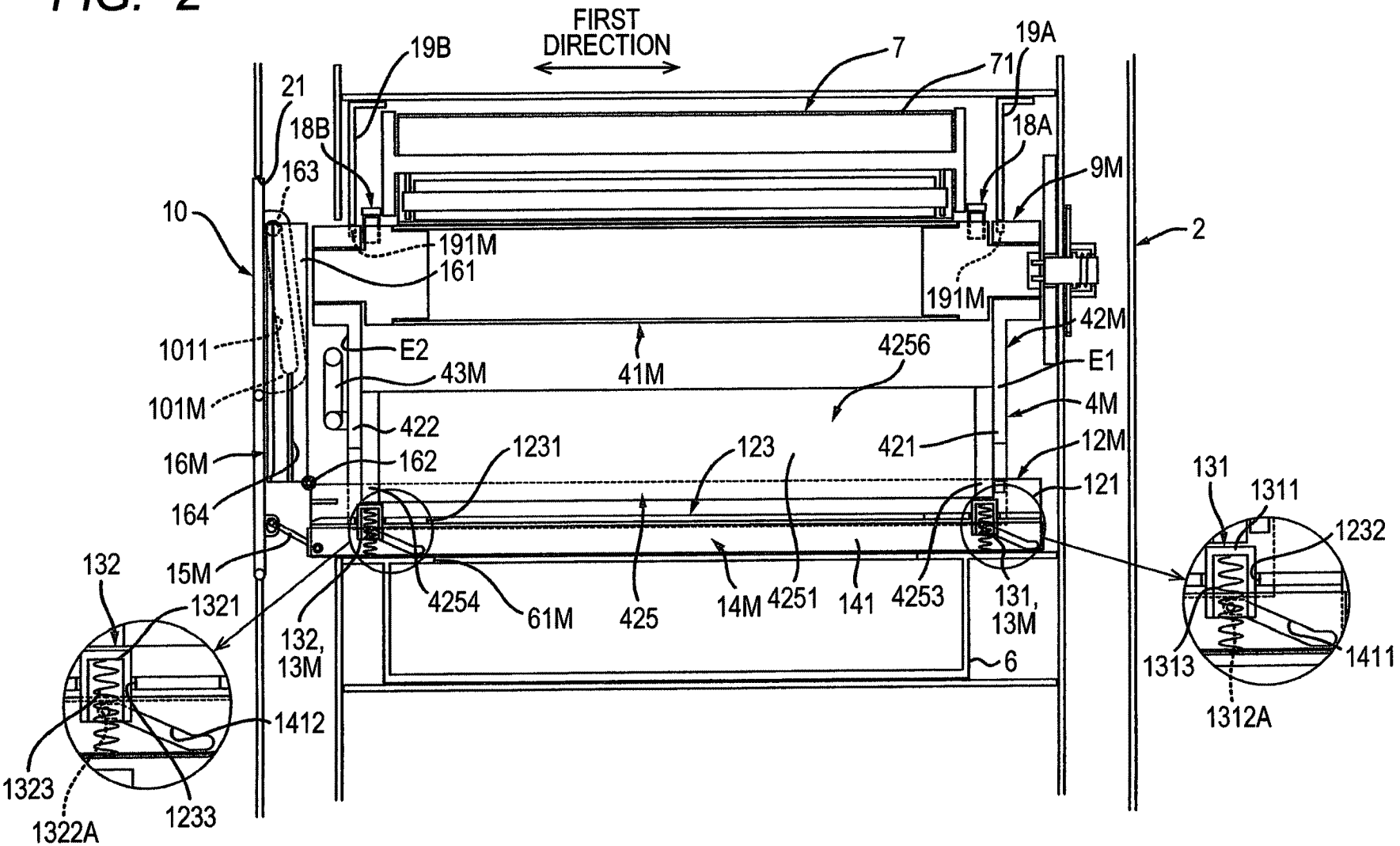
FIG. 2 is a cross-sectional view taken along a line A-A of the image forming apparatus shown in FIG. 1, showing a state where a cover is located at a closed position and a drum cartridge is located at a first position.

As shown in FIG. 2, the housing 2 has an opening 21. The opening 21 is located at one outer surface of the housing 2 in a first direction. The first direction is the direction in which a drum axis A1 of a photosensitive drum 41M extends in a state where a drum cartridge 4M is attached to the housing 2. The photosensitive drum 41M will be described later. In other words, the housing 2 has two walls apart from each other in the first direction, and one of the two walls has the opening 21.

1.2 Cover 10

Figure 3:
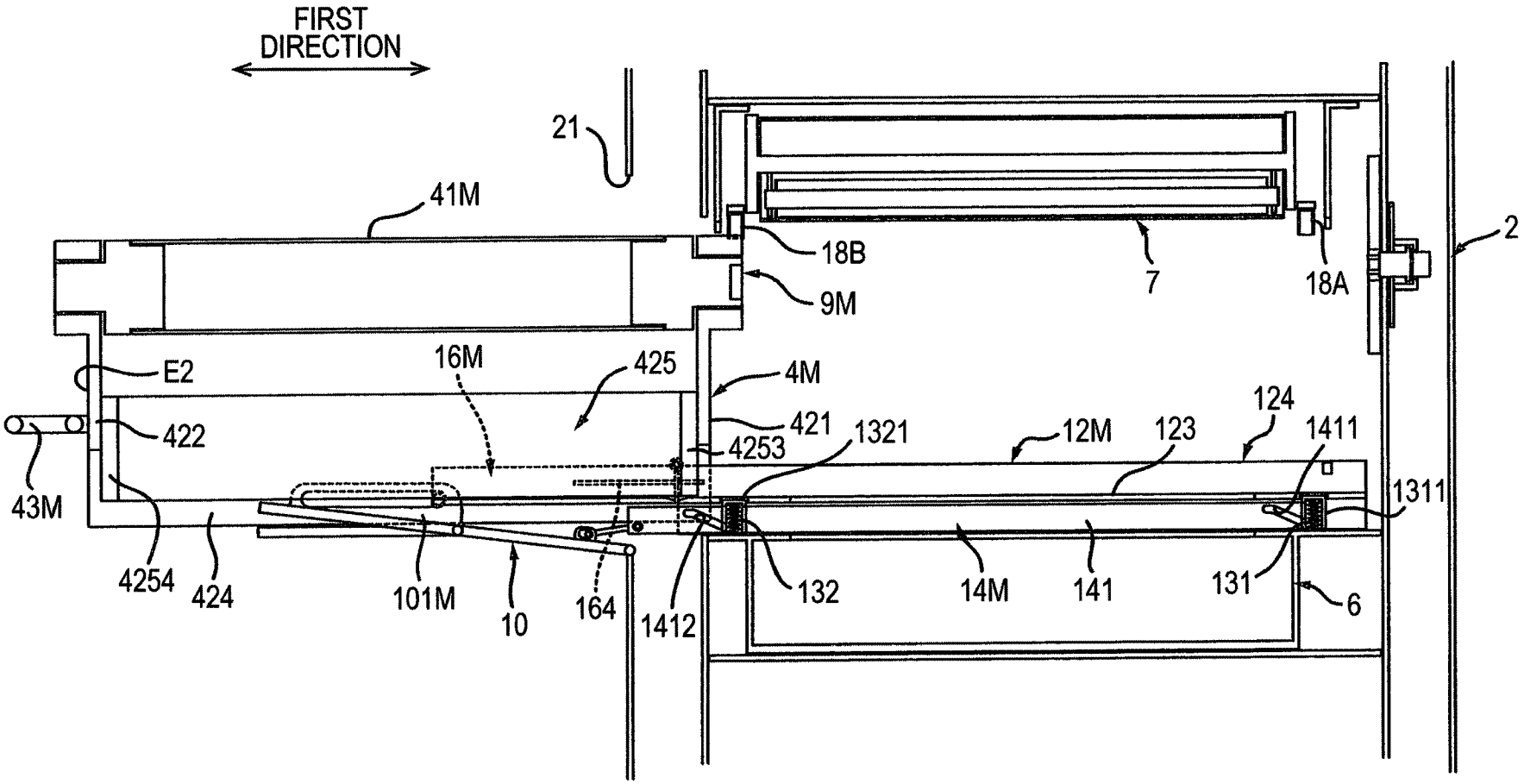
FIG. 3 is a cross-sectional view taken along the line A-A of the image forming apparatus shown in FIG. 1, showing a state where the cover is located at an open position and the drum cartridge is located between the first position and a second position.

As shown in FIGS. 2 and 3, the cover 10 is movable between a closed position (see FIG. 2) and an open position (see FIG. 3). The cover 10 closes the opening 21 in a state where the cover 10 is located at the closed position. The opening 21 opens in a state where the cover 10 is located at the open position.

1.3 Sheet Cassette 3

As shown in FIG. 1, the sheet cassette 3 accommodates a sheet S. The sheet S in the sheet cassette 3 is conveyed toward a transfer roller 72. The transfer roller 72 will be described later.

1.4 Four Process Cartridges 9Y, 9M, 9C, 9K

The four process cartridges 9Y, 9M, 9C, and 9K are arranged with an interval therebetween in a direction crossing the first direction. The four process cartridges 9Y, 9M, 9C, and 9K have the same structure as one another. Thus, the process cartridge 9M will be described in detail, and the description of the process cartridges 9Y, 9C, and 9K will be omitted.

1.4.1 Process Cartridge 9M

Figure 5:
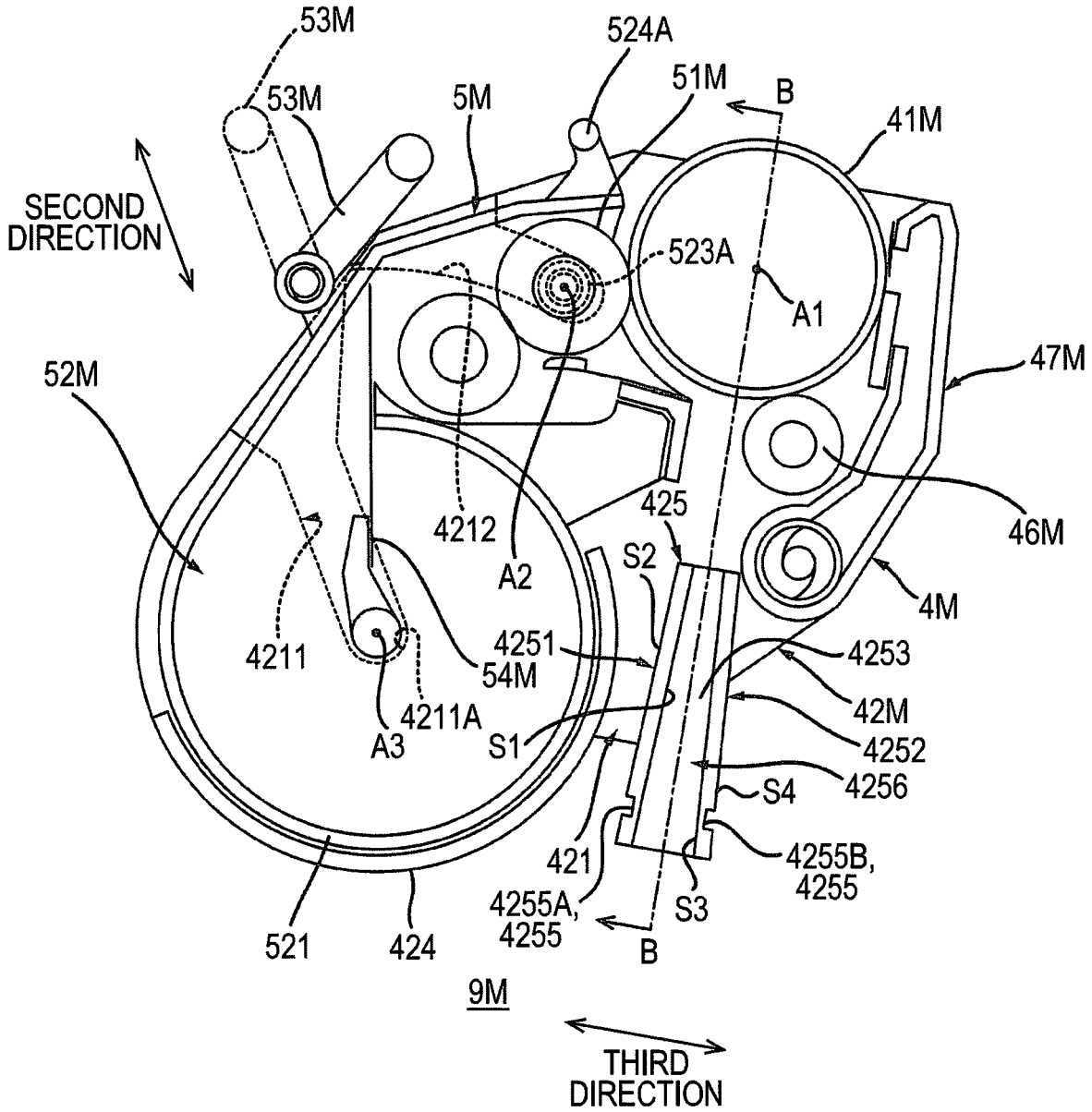
FIG. 5 shows a schematic configuration of a process cartridge shown in FIG. 1.

As shown in FIG. 5, the process cartridge 9M includes the drum cartridge 4M and a development cartridge 5M.

1.4.1.1 Drum Cartridge 4M

The drum cartridge 4M includes a photosensitive drum 41M and a charging device 46M.

The photosensitive drum 41M extends in the first direction. The photosensitive drum 41M has a cylindrical shape. The photosensitive drum 41M is rotatable about the drum axis A1. The drum axis A1 extends in the first direction.

The charging device 46M charges the circumferential surface of the photosensitive drum 41M. Specifically, the charging device 46M is a charging roller. The charging device 46M may be a scorotron charger.

Figure 4:
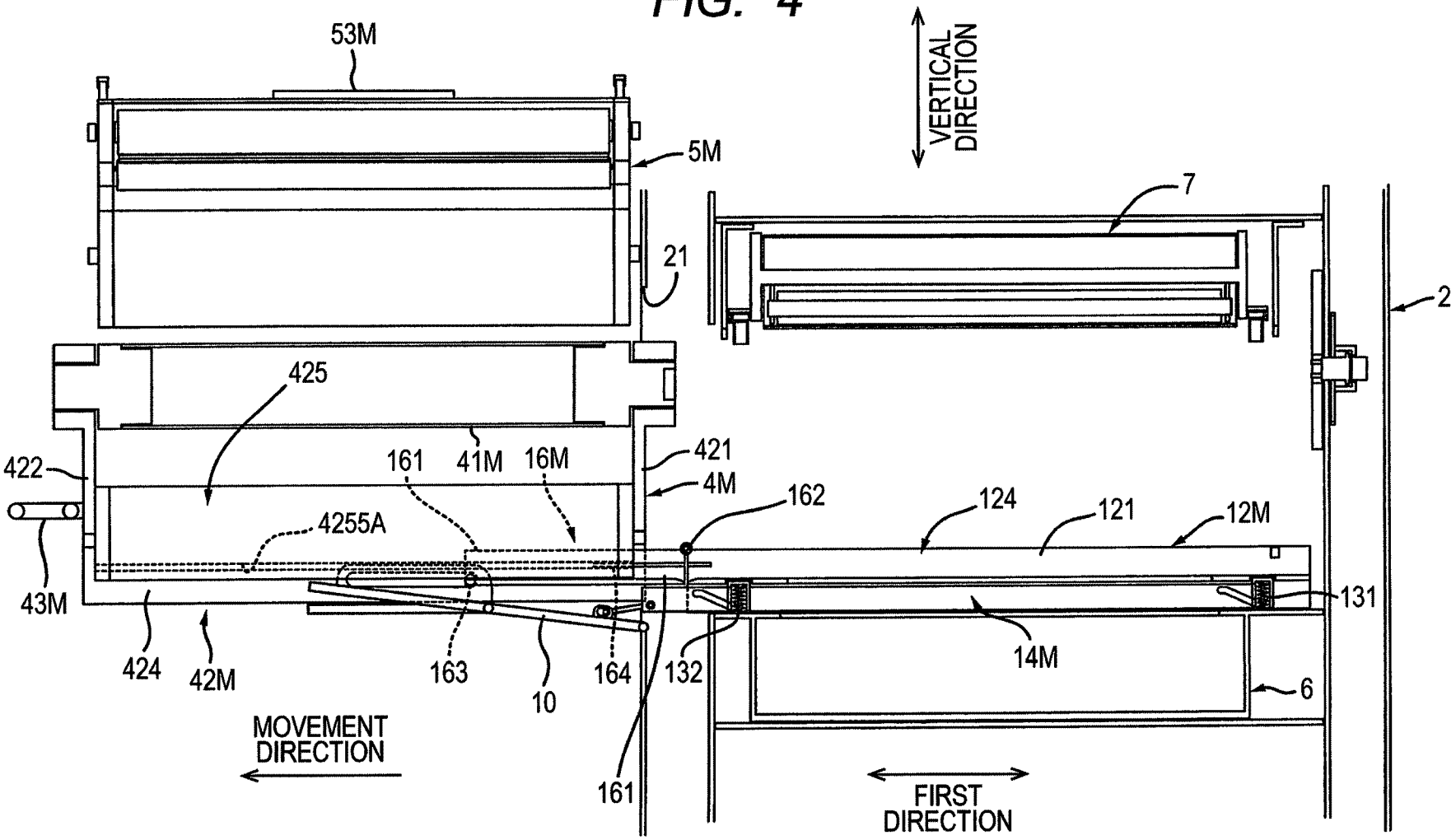
FIG. 4 is a cross-sectional view taken along the line A-A of the image forming apparatus shown in FIG. 1, showing a state where the cover is located at the open position and the drum cartridge is located at the second position.

As shown in FIGS. 2 and 3, the drum cartridge 4M is movable in the first direction through the opening 21 between a first position (see FIG. 2) and a second position (see FIG. 4). In a state where the drum cartridge 4M is located at the first position, the entirety of the drum cartridge 4M is located in the housing 2. In a state where the drum cartridge 4M is located at the second position, at least part of the drum cartridge 4M is located outside the housing 2.

1.4.1.2 Development Cartridge 5M

As shown in FIG. 5, the development cartridge 5M contains toner. The development cartridge 5M includes a development roller 51M and an agitator 54M. The development roller 51M extends in the first direction. The development roller 51M is rotatable about a development roller axis A2. The development roller axis A2 substantially extends in the first direction. The drum axis A1 and the development roller axis A2 may be parallel, or may not be parallel and may have an angle of several degrees in a state where the drum cartridge 4M is attached to the housing 2 and the development cartridge 5M is attached to the drum cartridge 4M. The agitator 54M is located away from the development roller 51M. The agitator 54M is rotatable about an agitator axis A3. The agitator axis A3 substantially extends in the first direction. The agitator axis A3 may be parallel to the first direction, or may not be parallel to the first direction and may have an angle of several degrees in a state where the drum cartridge 4M is attached to the housing 2 and the development cartridge 5M is attached to the drum cartridge 4M.

As shown in FIGS. 1 and 2, in a state where the drum cartridge 4M is located at the first position, the development cartridge 5M is undetachable from the drum cartridge 4M. In a state where the development cartridge 5M is attached to the drum cartridge 4M and the drum cartridge 4M is located at the first position, the development roller 51M is in contact with the photosensitive drum 41M. In a state where the development roller 51M is in contact with the photosensitive drum 41M, the development roller 51M supplies toner to the photosensitive drum 41M.

As shown in FIG. 4, in a state where the drum cartridge 4M is located at the second position, the development cartridge 5M is attachable to and detachable from the drum cartridge 4M. In a state where the drum cartridge 4M is located at the second position, the development cartridge 5M is detachable upward from the drum cartridge 4M. The "upward" is upward in the gravitational direction when the image forming apparatus 1 is placed in a normal use state.

Thus, the development cartridge 5M containing toner and including the development roller 51M and the drum cartridge 4M including the photosensitive drum 41M can be individually replaced.

1.4.2 Process Cartridges 9Y, 9C, 9K

As shown in FIG. 1, the process cartridge 9Y includes a drum cartridge 4Y and a development cartridge 5Y. The drum cartridge 4Y includes a photosensitive drum 41Y and a charging device 46Y. The development cartridge 5Y includes a development roller 51Y and an agitator 54Y. The development cartridge 5Y is attachable to and detachable from the drum cartridge 4Y.

The process cartridge 9C includes a drum cartridge 4C and a development cartridge 5C. The drum cartridge 4C includes a photosensitive drum 41C and a charging device 46C. The development cartridge 5C includes a development roller 51C and an agitator 54C. The development cartridge 5C is attachable to and detachable from the drum cartridge 4C.

The process cartridge 9K includes a drum cartridge 4K and a development cartridge 5K. The drum cartridge 4K includes a photosensitive drum 41K and a charging device 46K. The development cartridge 5K includes a development roller 51K and an agitator 54K. The development cartridge 5K is attachable to and detachable from the drum cartridge 4K.

In other words, the image forming apparatus 1 includes four drum cartridges 4Y, 4M, 4C, 4K and four development cartridges 5Y, 5M, 5C, 5K.

1.5. Exposure Device 6

The exposure device 6 exposes the surfaces of four photosensitive drums 41Y, 41M, 41C, and 41K. In a state where the drum cartridge 4M is located at the first position, the exposure device 6 is located below the drum cartridge 4M.

The exposure device 6 has four light emitting openings 61Y, 61M, 61C, and 61K. The four light emitting openings 61Y, 61M, 61C, and 61K are arranged with an interval from each other.

The light emitting opening 61Y emits light that exposes the charged surface of the photosensitive drum 41Y. As a result, an electrostatic latent image is formed on the surface of the photosensitive drum 41Y. The light emitting opening 61M emits light that exposes the charged surface of the photosensitive drum 41M. As a result, an electrostatic latent image is formed on the surface of the photosensitive drum 41M. The light emitting opening 61C emits light that exposes the charged surface of the photosensitive drum 41C. As a result, an electrostatic latent image is formed on the surface of the photosensitive drum 41C. The light emitting opening 61K emits light that exposes the charged surface of the photosensitive drum 41K. As a result, an electrostatic latent image is formed on the surface of the photosensitive drum 41K.

Specifically, the exposure device 6 is a laser scan unit. The exposure device 6 may be an LED array.

1.6 Transfer Device 7

The transfer device 7 transfers toner from the four photosensitive drums 41Y, 41M, 41C, and 41K to the sheet S. In a state where the drum cartridge 4M is located at the first position, the transfer device 7 is located at the opposite side of the exposure device 6 with respect to the drum cartridge 4M. In a state where the drum cartridge 4M is located at the first position, the drum cartridge 4M is located below the transfer device 7. The transfer device 7 includes an intermediate transfer belt 71 and a transfer roller 72.

In a state where the four drum cartridges 4Y, 4M, 4C and 4K are located at the first position, the intermediate transfer belt 71 contacts the four photosensitive drums 41Y, 41M, 41C and 41K. The toner on the four photosensitive drums 41Y, 41M, 41C, and 41K is transferred to the intermediate transfer belt 71.

The transfer roller 72 transfers the toner on the intermediate transfer belt 71 to the sheet S. The transfer roller 72 is aligned with the intermediate transfer belt 71 in a direction that crosses the first direction and the vertical direction. The transfer roller 72 contacts the intermediate transfer belt 71. The sheet S conveyed from the sheet cassette 3 passes between the intermediate transfer belt 71 and the transfer roller 72. At this time, the transfer roller 72 transfers the toner transferred to the intermediate transfer belt 71 to the sheet S.

1.7 Fixing Device 8

The fixing device 8 heats and pressurizes the sheet S on which the toner is transferred to fix the toner on the sheet S. The sheet S that has passed through the fixing device 8 is discharged to the upper surface of the housing 2.

2. Details of Drum Cartridge 4M

Next, the details of the drum cartridge 4M will be described with reference to FIGS. 5 to 7.

Figure 6:
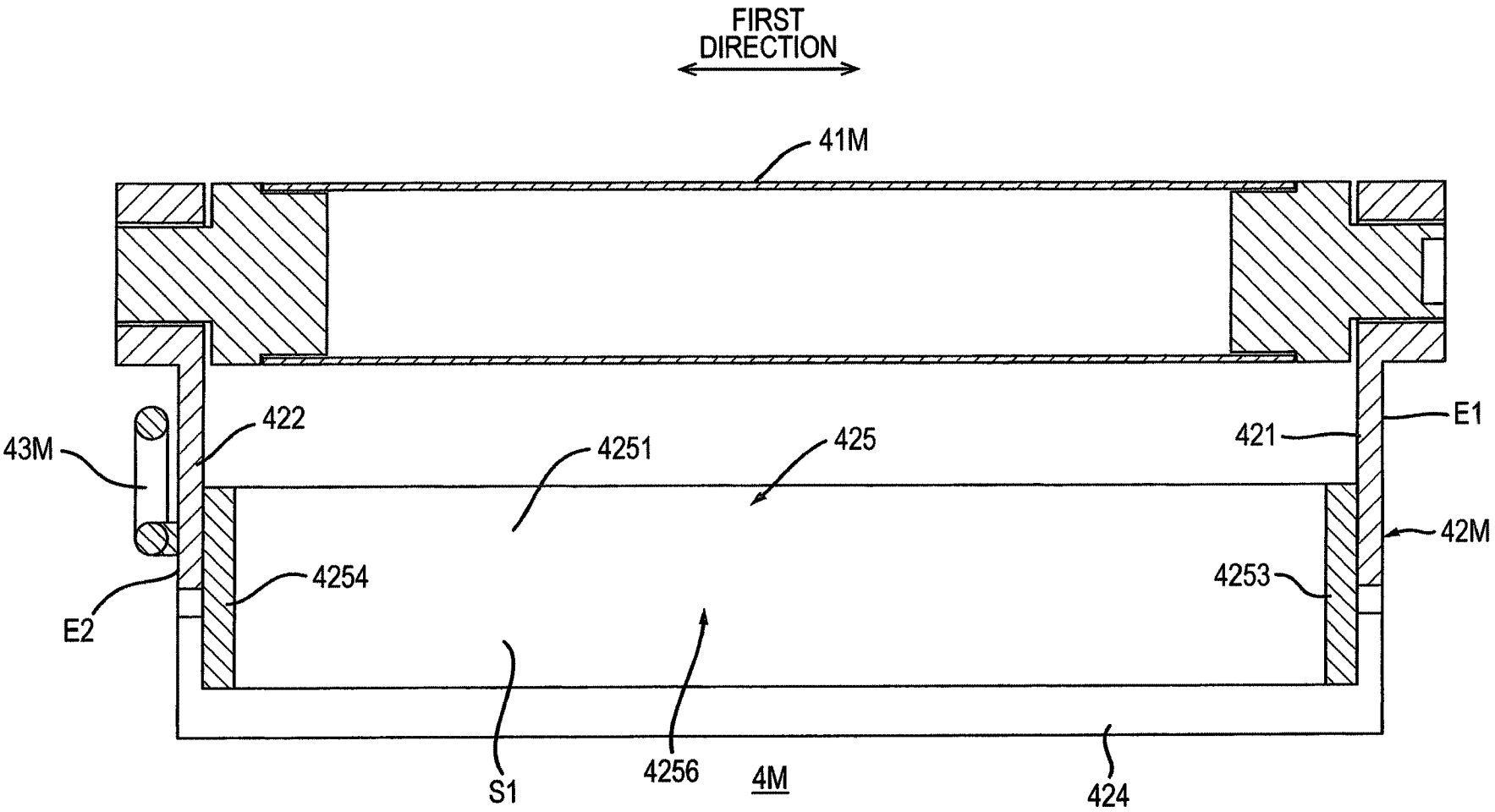
FIG. 6 is a cross-sectional view taken along a line B-B of the process cartridge shown in FIG. 5.

As shown in FIG. 6, the drum cartridge 4M extends in the first direction. The drum cartridge 4M has one end E1 and an other end E2 in the first direction. The other end E2 of the drum cartridge 4M is located away from the one end E1 of the drum cartridge 4M.

As shown in FIGS. 5 and 6, the drum cartridge 4M includes a drum frame 42M, a drum cleaner 47M (see FIG. 5), and a first handle 43M (see FIG. 6) in addition to the above-mentioned photosensitive drum 41M and charging device 46M (see FIG. 5).

2.1 Drum Frame 42M

The drum frame 42M supports the photosensitive drum 41M, the charging device 46M, the drum cleaner 47M, and the first handle 43M. The drum frame 42M includes a first side plate 421 (see FIG. 4), a second side plate 422, a bottom plate 424, and a contact portion 425. In other words, the drum cartridge 4M includes the first side plate 421, the second side plate 422, the bottom plate 424, and the contact portion 425.

2.1.1 First Side Plate 421 and Second Side Plate 422

As shown in FIG. 6, the first side plate 421 is located at the one end E1 of the drum cartridge 4M. The first side plate 421 supports one end of the photosensitive drum 41M in the first direction. The second side plate 422 is located at the other end E2 of the drum cartridge 4M. The second side plate 422 is located away from the first side plate 421 in the first direction. The second side plate 422 supports the other end of the photosensitive drum 41M in the first direction.

Figure 7:
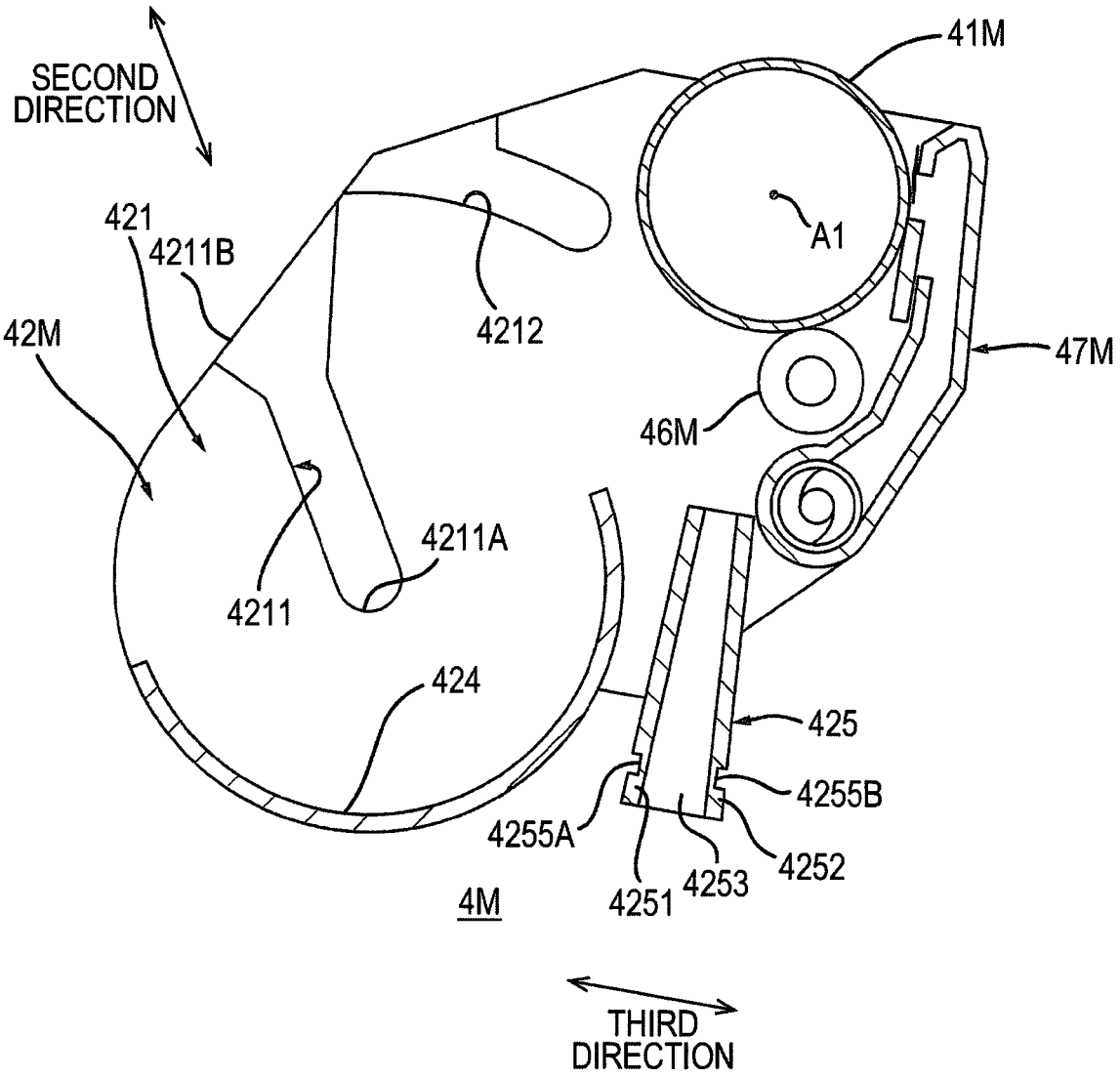
FIG. 7 shows a schematic configuration of the drum cartridge shown in FIG. 5.

As shown in FIG. 7, each of the first side plate 421 and the second side plate 422 has a first guide 4211 and a second guide 4212. The first guide 4211 and the second guide 4212 of the first side plate 421 will be described in detail, and the descriptions of the first guide 4211 and the second guide 4212 of the second side plate 422 will be omitted.

The first guide 4211 guides the attachment and detachment of the development cartridge 5M relative to the drum cartridge 4M. When the development cartridge 5M is attached to the drum cartridge 4M, the first guide 4211 guides a first boss 522A. The first boss 522A will be described later. The first guide 4211 is located on the inner surface of the first side plate 421 in the first direction. The inner surface of the first side plate 421 faces the second side plate 422 in the first direction (see FIG. 6). Specifically, the first guide 4211 is a groove. The first guide 4211 extends in a second direction. The second direction crosses the first direction.

The first guide 4211 has a first end 4211A and a second end 4211B in the second direction. The first end 4211A is located between the bottom plate 424 and the second end 4211B. The second end 4211B is located away from the first end 4211A. The second end 4211B is located at an edge of the first side plate 421. The second end 4211B is open.

The second guide 4212 guides a second boss 523A when the development cartridge 5M rotationally moves relative to the photosensitive drum 41M. The second boss 523A will be described later. The second guide 4212 is located on the inner surface of the first side plate 421 in the first direction. The second guide 4212 is located between the photosensitive drum 41M and the first guide 4211. Specifically, the second guide 4212 is a groove. The second guide 4212 extends in an arc shape about the agitator axis A3 as the center (see FIG. 5).

2.1.2 Bottom Plate 424

As shown in FIG. 6, the bottom plate 424 is located between the first side plate 421 and the second side plate 422 in the first direction. The bottom plate 424 has an arc shape about the agitator axis A3 as the center (see FIG. 5). The bottom plate 424 extends in the first direction. One end of the bottom plate 424 in the first direction is connected to the first side plate 421. The other end of the bottom plate 424 in the first direction is connected to the second side plate 422.

2.1.3 Contact Portion 425

As shown in FIG. 1, in a state where the drum cartridge 4M is located at the first position, the contact portion 425 is fitted to a rail 12M. When the drum cartridge 4M moves between the first position and the second position, the contact portion 425 slides along the rail 12M. The rail 12M will be described later. In a state where the drum cartridge 4M is located at the second position, the contact portion 425 contacts a stopper 164 (see FIG. 4). The stopper 164 will be described later.

As shown in FIGS. 5 and 6, the contact portion 425 is located between the first side plate 421 and the second side plate 422 in the first direction. The contact portion 425 is located away from the photosensitive drum 41M in a radial direction of the photosensitive drum 41M. The contact portion 425 is located between the bottom plate 424 and the drum cleaner 47M in a third direction. The third direction crosses the first direction and the second direction. The contact portion 425 has a tubular shape. The contact portion 425 extends in the radial direction of the photosensitive drum 41M. The contact portion 425 includes a first wall 4251, a second wall 4252, a third wall 4253, and a fourth wall 4254.

In a state where the drum cartridge 4M is located at the first position, the first wall 4251 and the second wall 4252 extend toward the photosensitive drum 41M. Each of the first wall 4251 and the second wall 4252 extends in the first direction. The second wall 4252 is located at the opposite side of the bottom plate 424 with respect to the first wall 4251. The first wall 4251 and the second wall 4252 are located apart from each other in the third direction.

The first wall 4251 has an inner surface S1 and an outer surface S2 in the third direction. The inner surface S1 of the first wall 4251 faces the second wall 4252 in the third direction. The outer surface S2 of the first wall 4251 is located at the opposite side of the second wall 4252 with respect to the inner surface S1 in the third direction.

The second wall 4252 has an inner surface S3 and an outer surface S4 in the third direction. The inner surface S3 of the second wall 4252 faces the first wall 4251 in the third direction. The outer surface S4 of the second wall 4252 is located at the opposite side of the first wall 4251 with respect to the inner surface S3 in the third direction.

Each of the first wall 4251 and the second wall 4252 has a groove 4255. In a state where the drum cartridge 4M is located at the second position, a protrusion as the stopper 164 fits in the groove 4255. The protrusion will be described later. In the following, the groove 4255 of the first wall 4251 will be referred to as a groove 4255A, and the groove 4255 of the second wall 4252 will be referred to as a groove 4255B.

The groove 4255A is located on the outer surface S2 of the first wall 4251. The groove 4255A is recessed from the outer surface S2 in the third direction. The groove 4255A extends in the first direction. The groove 4255A is provided over the entire outer surface S2 in the first direction. The groove 4255B is located on the outer surface S4 of the second wall 4252. The groove 4255B is described in the same manner as the groove 4255A. Thus, the description of the groove 4255B is omitted.

The third wall 4253 and the fourth wall 4254 are located apart from each other in the first direction. The third wall 4253 is connected to one end of the first wall 4251 in the first direction and one end of the second wall 4252 in the first direction. The fourth wall 4254 is connected to the other end of the first wall 4251 in the first direction and the other end of the second wall 4252 in the first direction.

The contact portion 425 has a through hole 4256. The through hole 4256 is formed to penetrate the contact portion 425 in the radial direction of the photosensitive drum 41M. The through hole 4256 is defined by the inner surfaces of the contact portion 425. The through hole 4256 is a space surrounded by the first wall 4251, the second wall 4252, the third wall 4253, and the fourth wall 4254. The through hole 4256 is located between the inner surface S1 of the first wall 4251 and the inner surface S3 of the second wall 4252. Light from the exposure device 6 passes through the through hole 4256 (see FIG. 1).

2.2 Drum Cleaner 47M

As shown in FIG. 5, the drum cleaner 47M cleans the surface of the photosensitive drum 41M. In a state where the development cartridge 5M is attached to the drum cartridge 4M, the drum cleaner 47M is located at the opposite side of the development roller 51M with respect to the drum axis A1 in the third direction.

2.3 First Handle 43M

As shown in FIGS. 2 and 3, the first handle 43M is located at the downstream end of the drum cartridge 4M in the movement direction when the drum cartridge 4M moves from the first position to the second position. The first handle 43M is located at the other end E2 of the drum cartridge 4M. The first handle 43M is attached to the second side plate 422. The first handle 43M is located at the opposite side of the first side plate 421 with respect to the second side plate 422 in the first direction.

The first handle 43M is rotationally movable between a folded position (see FIG. 2) and a protruding position (see FIG. 3). In a state where the first handle 43M is located at the folded position, the first handle 43M extends in the vertical direction along the second side plate 422. In a state where the first handle 43M is located at the protruding position, the first handle 43M extends from the second side plate 422 in the first direction.

3. Details of Development Cartridge 5M

Next, the details of the development cartridge 5M will be described with reference to FIGS. 5 and 8.

As shown in FIG. 5, the development cartridge 5M includes a development frame 52M and a second handle 53M in addition to the development roller 51M and the agitator 54M described above.

3.1 Development Frame 52M

The development frame 52M supports the development roller 51M, the agitator 54M, and the second handle 53M. As shown in FIG. 8, the development frame 52M includes a development housing 521, two first bosses 522A and 522B, two second bosses 523A and 523B, and two pressed portions 524A and 524B. In other words, the development cartridge 5M includes the two first bosses 522A and 522B, the two second bosses 523A and 523B, and the two pressed portions 524A and 524B.

3.1.1 Development Housing 521

The development housing 521 contains toner. The development housing 521 extends in the first direction. The development housing 521 has a first side surface S5 and a second side surface S6 in the first direction.

The first side surface S5 is located at one end of the development housing 521 in the first direction. The second side surface S6 is located at the other end of the development housing 521 in the first direction. The second side surface S6 is located away from the first side surface S5 in the first direction.

In a state where the development cartridge 5M is attached to the drum cartridge 4M, the development housing 521 of the development cartridge 5M is located between the first side plate 421 and the second side plate 422 in the first direction.

3.1.2 First Boss 522A, 522B

The first boss 522A is located on the first side surface S5 of the development housing 521. The first boss 522A has a cylindrical shape. The first boss 522A extends in the first direction. The first boss 522A extends along the agitator axis A3 of the agitator 54M. The first boss 522B is located on the second side surface S6 of the development housing 521. The first boss 522B is described in a similar manner to the first boss 522A.

In a state where the development cartridge 5M is attached to the drum cartridge 4M, the first boss 522A fits into the first end 4211A of the first guide 4211. As shown in FIG. 5, in a state where the development cartridge 5M is attached to the drum cartridge 4M, the development cartridge 5M is rotationally movable relative to the drum cartridge 4M about the agitator axis A3. Thus, the development roller 51M is movable relative to the photosensitive drum 41M.

3.1.3 Second Boss 523A, 523B

Figure 8:
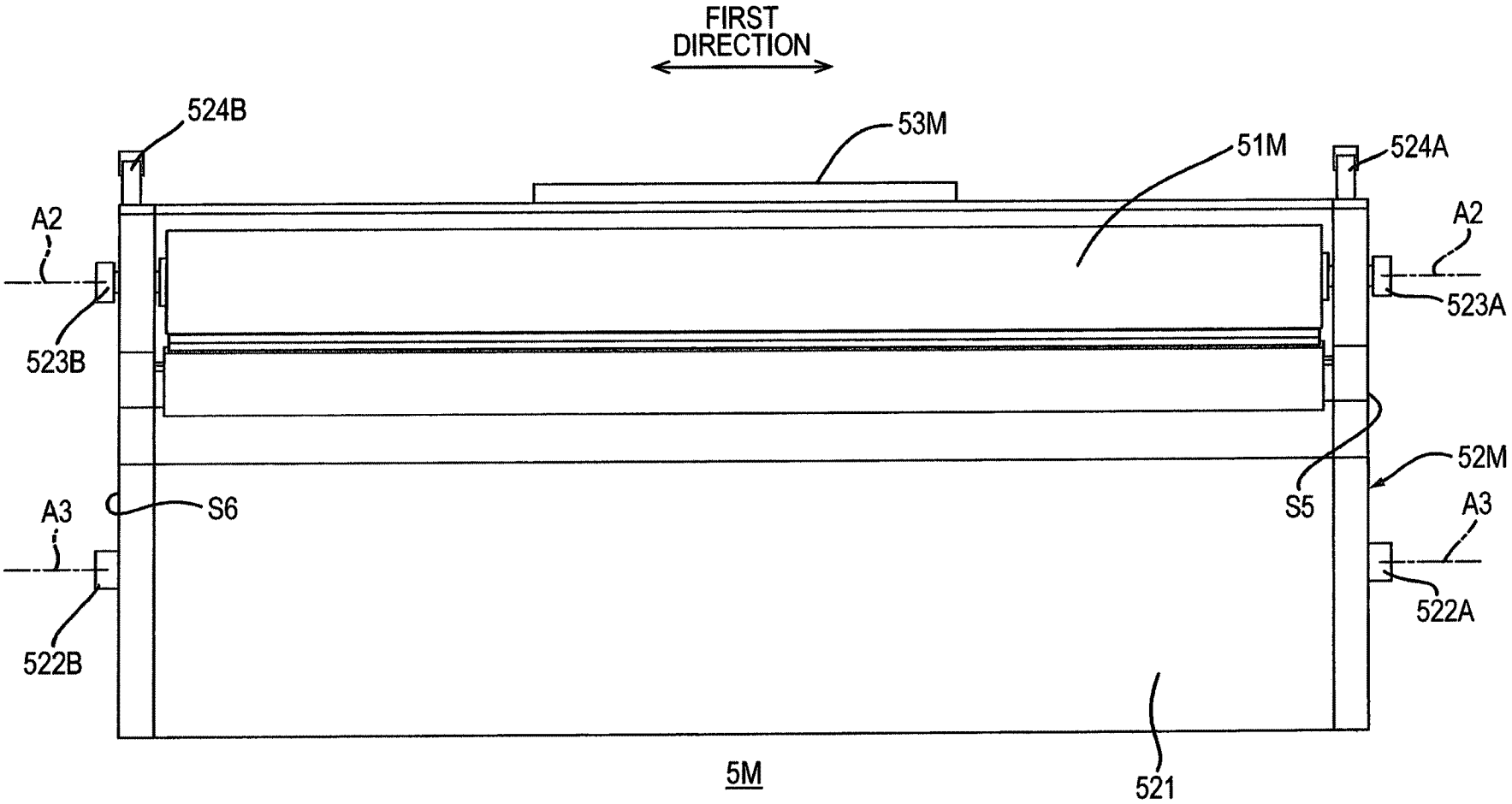
FIG. 8 is a front view of a development cartridge shown in FIG. 5.

As shown in FIG. 8, the second boss 523A is located on the first side surface S5 of the development housing 521. The second boss 523A is located away from the first boss 522A. The second boss 523A has a cylindrical shape. The second boss 523A extends along the development roller axis A2 of the development roller 51M. The second boss 523A extends in the first direction. The second boss 523B is located on the second side surface S6 of the development housing 521. The second boss 523B is described in a similar manner to the second boss 523A.

As shown in FIG. 5, in a state where the development cartridge 5M is attached to the drum cartridge 4M, the second boss 523A fits in the second guide 4212. When the development cartridge 5M rotationally moves relative to the drum cartridge 4M, the second boss 523B is guided by the second guide 4212.

3.1.4 Pressed Portion 524A, 524B

As shown in FIG. 1, the two pressed portions 524A and 524B are pressed by the development pressing members 18A and 18B. The development pressing members 18A and 18B will be described later.

As shown in FIG. 8, the two pressed portions 524A and 524B are spaced apart from each other in the first direction. In a state where the development cartridge 5M is attached to the drum cartridge 4M and the drum cartridge 4M is located at the first position, each of the two pressed portions 524A and 524B protrudes upward from the development frame 52M. Each of the two pressed portions 524A and 524B protrudes from the development housing 521 in a direction crossing the first direction. The pressed portion 524A protrudes upward from one end of the development housing 521 in the first direction. The pressed portion 524B protrudes upward from the other end of the development housing 521 in the first direction.

3.2 Second Handle 53M

The second handle 53M is located between the two pressed portions 524A and 524B in the first direction. The second handle 53M is attached to the development frame 52M. The second handle 53M is attached to the center of the development housing 521 in the first direction. The color of the second handle 53M is different from the color of the first handle 43M. The second handle 53M is located upstream of the first handle 43M in the movement direction in a state where the development cartridge 5M is attached to the drum cartridge 4M (see FIG. 4).

As shown in FIG. 5, the second handle 53M is rotationally movable between a first position and a second position. In a state where the second handle 53M is located at the first position, the second handle 53M crosses the direction in which the first guide 4211 extends. In a state where the second handle 53M is located at the first position, the second handle 53M extends along the surface of the development housing 521.

In a state where the second handle 53M is located at the second position, the second handle 53M extends in the direction in which the first guide 4211 extends. Thus, in a state where the development cartridge 5M is attached to the drum cartridge 4M and the second handle 53M is located at the second position, when the user holds the second handle 53 and pulls up the development cartridge 5M in the direction in which the first guide 4211 extends, the first boss 522A smoothly exits from first guide 4211. Thus, the development cartridge 5M can be smoothly detached from the drum cartridge 4M.

4. Details of the Image Forming Apparatus

Next, the details of the image forming apparatus 1 will be described with reference to FIGS. 1 to 4.

As shown in FIGS. 1 and 2, the image forming apparatus 1 includes four drum guides 17Y, 17M, 17C, 17K, four rails 12Y, 12M, 12C, 12K, two drum positioning plates 19A, 19B, four drum pressing units 13Y, 13M, 13C, 13K, four cams 14Y, 14M, 14C, 14K, two development pressing members 18A, 18B (see FIG. 2), and four support portions 16Y, 16M, 16C, 16K. The cams 14Y, 14C, 14K and the support portions 16Y, 16C, 16K are not shown.

4.1 Four Drum Guides 17Y, 17M, 17C, 17K

As shown in FIG. 1, the four drum guides 17Y, 17M, 17C, and 17K are located in the housing 2. The four drum guides 17Y, 17M, 17C and 17K are supported by the exposure device 6. The four drum guides 17Y, 17M, 17C, and 17K are arranged with an interval therebetween.

The four drum guides 17Y, 17M, 17C and 17K have the same structure as one another. Thus, the drum guide 17M will be described in detail, and the description of the three drum guides 17Y, 17C, and 17K will be omitted. The drum guide 17M guides the movement of the drum cartridge 4M between the first position and the second position. The drum guide 17M substantially extends in the first direction. The direction in which the drum guide 17M extends may be parallel to the first direction, or may not be parallel to the first direction and may have an angle of several degrees in a state where the drum cartridge 4M is attached to the housing 2 and the development cartridge 5M is attached to the drum cartridge 4M. The drum guide 17M extends along the bottom plate 424 of the drum frame 42M. Thus, the drum cartridge 4M is smoothly movable between the first position and the second position.

4.2 Four Rails 12Y, 12M, 12C, 12K

The four rails 12Y, 12M, 12C, and 12K are located in the housing 2. The four rails 12Y, 12M, 12C and 12K are supported by the exposure device 6. The rail 12Y is located between the drum guide 17Y and the drum guide 17M. The rail 12M is located between the drum guide 17M and the drum guide 17C. The rail 12C is located between drum guide 17C and drum guide 17K. The rail 12K is located at the opposite side of the rail 12C with respect to the drum guide 17K.

The four rails 12Y, 12M, 12C, and 12K have the same structure as one another. Thus, the rail 12M will be described in detail, and the description of the three rails 12Y, 12C, and 12K will be omitted.

4.2.1 Rail 12M

The rail 12M guides the contact portion 425 when the drum cartridge 4M moves between the first position and the second position. The rail 12M includes a rail main body 124 and two leg portions 125A and 125B.

The rail main body 124 has a U-shape. The rail 12M is opened upward. The rail main body 124 includes a first wall 121, a second wall 122, and a third wall 123.

Each of the first wall 121 and the second wall 122 extends in the first direction. The second wall 122 is located at the opposite side of the first wall 121 with respect to a light emitting opening 61M in a direction crossing the first direction and the vertical direction. The third wall 123 is located between the first wall 121 and the second wall 122 in the direction crossing the first direction and the vertical direction. The third wall 123 connects the lower end of the first wall 121 and the lower end of the second wall 122.

As shown in FIG. 2, the third wall 123 has an opening 1231, a first hole 1232, and a second hole 1233.

Light emitted from the light emitting opening 61M of the exposure device 6 passes through the opening 1231. The light that has passed through the opening 1231 exposes the photosensitive drum 41M after passing through the through hole 4256. The opening 1231 extends in the first direction.

The first hole 1232 is located away from the opening 1231 in the first direction. A first drum pressing member 131 is arranged in the first hole 1232. The first drum pressing member 131 will be described later.

The second hole 1233 is located at the opposite side of the first hole 1232 with respect to the opening 1231 in the first direction. A second drum pressing member 132 is arranged in the second hole 1233. The second drum pressing member 132 will be described later.

As shown in FIG. 1, in a state where the drum cartridge 4M is located at the first position, the contact portion 425 is located between the first wall 121 and the second wall 122. In a state where the drum cartridge 4M is located at the first position, the contact portion 425 is located between the photosensitive drum 41M and the third wall 123.

The two leg portions 125A and 125B support the rail main body 124. The two leg portions 125 are located between the rail main body 124 and the exposure device 6. The two leg portions 125A and 125B are located away from each other in the direction that crosses the first direction and the vertical direction. The leg portion 125B is located at the opposite side of the leg portion 125A with respect to the light emitting opening 61M. Each of the two leg portions 125A and 125B extends in the first direction.

4.3 Two Drum Positioning Plates 19A, 19B

As shown in FIG. 2, in a state where the cover 10 is located at the closed position and the drum cartridge 4M is located at the first position, the two drum positioning plates 19A and 19B position the four photosensitive drums 41Y, 41M, 41C, and 41K relative to the housing 2. The two drum positioning plates 19A and 19B are supported by the housing 2. Each of the two drum positioning plates 19A and 19B has an L-shape.

In a state where the cover 10 is located at the closed position, the drum positioning plate 19A is located at the opposite side of the cover 10 with respect to the transfer device 7 in the first direction. The drum positioning plate 19A has four recesses 191Y, 191M, 191C and 191K. The recesses 191Y, 191C, and 191K are not shown. The four recesses 191Y, 191M, 191C and 191K have the same structure as one another. Thus, the recess 191M will be described, and the description of the three recesses 191Y, 191C, and 191K will be omitted. The recess 191M is recessed upward from the lower end of the drum positioning plate 19A.

The drum positioning plate 19B is located at the opposite side of the drum positioning plate 19A with respect to the transfer device 7 in the first direction. In a state where the cover 10 is located at the closed position, the drum positioning plate 19B is located between the cover 10 and the transfer device 7 in the first direction. The drum positioning plate 19B will be described in the same manner as the drum positioning plate 19A. Thus, the description of the drum positioning plate 19B is omitted.

4.4 Four Drum Pressing Units 13Y, 13M, 13C, 13K

As shown in FIG. 1, the four drum pressing units 13Y, 13M, 13C, and 13K have the same structure as one another. Thus, the drum pressing unit 13M will be described in detail, and the description of the three drum pressing units 13Y, 13C, and 13K will be omitted.

In a state where the drum cartridge 4M is located at the first position, the drum pressing unit 13M is configured to press the photosensitive drum 41M toward the transfer device 7 such that the photosensitive drum 41M fits in the recess 191M of the drum positioning plates 19A and 19B.

4.4.1 Drum Pressing Unit 13M

As shown in FIG. 2, in a state where the drum cartridge 4M is located at the first position, the drum pressing unit 13M is located at the opposite side of the photosensitive drum 41M with respect to the drum frame 42M. The drum pressing unit 13M includes the first drum pressing member 131 and the second drum pressing member 132. In other words, the image forming apparatus 1 includes the first drum pressing member 131 and the second drum pressing member 132.

As shown in FIGS. 2 and 3, in a state where the drum cartridge 4M is located at the first position, the first drum pressing member 131 presses the photosensitive drum 41M toward the transfer device 7 and the recess 191M of the drum positioning plate 19A. The first drum pressing member 131 is located at the opposite side of the photosensitive drum 41M with respect to the contact portion 425. The first drum pressing member 131 is located away from the light emitting opening 61M in the first direction, and is located between the light emitting opening 61M and the photosensitive drum 41M in the vertical direction.

The first drum pressing member 131 is located in the first hole 1232. The first drum pressing member 131 is movable between a pressing position (see FIG. 2) and a release position (see FIG. 3). In a state where the drum cartridge 4M is located at the first position and the first drum pressing member 131 is located at the pressing position, the first drum pressing member 131 presses the third wall 4253 toward the transfer device 7 (FIG. 2). In a state where the drum cartridge 4M is located at the first position and the first drum pressing member 131 is located at the release position, the first drum pressing member 131 releases the pressure on the third wall 4253.

As shown in FIG. 1, the first drum pressing member 131 includes a contact portion 1311, two bosses 1312A and 1312B, and a spring 1313.

As shown in FIG. 2, in a state where the drum cartridge 4M is located at the first position, the contact portion 1311 is in contact with the third wall 4253. The contact portion 1311 extends in the vertical direction. The contact portion 1311 has a tubular shape. The upper end of the contact portion 1311 is closed. The lower end of the contact portion 1311 is open.

Each of the two bosses 1312A and 1312B fits in a first elongated hole 1411. The first elongated hole 1411 will be described later. The boss 1312A protrudes from the contact portion 1311 toward the leg portion 125A (see FIG. 1). The boss 1312B is located at the opposite side of the boss 1312A with respect to the contact portion 1311. The boss 1312B is described similarly to the boss 1312A.

The spring 1313 presses the contact portion 1311 toward the photosensitive drum 41M. The spring 1313 is arranged in the contact portion 1311.

In a state where the first drum pressing member 131 is located at the pressing position, the contact portion 1311 protrudes upward from the third wall 123. In a state where the first drum pressing member 131 is located at the release position, the contact portion 1311 is located below the pressing position and is flush with the third wall 123 (see FIG. 3).

In a state where the drum cartridge 4M is located at the first position, the second drum pressing member 132 presses the photosensitive drum 41M toward the transfer device 7 and the recess 191M of the drum positioning plate 19B. The second drum pressing member 132 is located at the opposite side of the photosensitive drum 41M with respect to the contact portion 425. The second drum pressing member 132 is located at the opposite side of the first drum pressing member 131 with respect to the light emitting opening 61M in the first direction.

The second drum pressing member 132 is located in the second hole 1233. The second drum pressing member 132 is described in the same manner as the first drum pressing member 131. Thus, the description of the second drum pressing member 132 is omitted. The second drum pressing member 132 includes a contact portion 1321, two bosses 1322A and 1322B, and a spring 1323.

In a state where the drum cartridge 4M is located at the first position and the second drum pressing member 132 is located at the pressing position, the second drum pressing member 132 presses the fourth wall 4254 toward the transfer device 7 (FIG. 2). Thus, in a state where the drum cartridge 4M is located at the first position and the first drum pressing member 131 and the second drum pressing member 132 are located at the pressing position, the second drum pressing member 132, in cooperation with the first drum pressing member 131, presses the photosensitive drum 41M toward the transfer device 7 and the recesses 191M of the two drum positioning plates 19A and 19B. At this time, the upper end of the first side plate 421 contacts the recess 191M of the drum positioning plate 19A, and the upper end of the second side plate 422 contacts the recess 191M of the drum positioning plate 19B. In this way, the photosensitive drum 41M contacts the intermediate transfer belt 71 and is positioned relative to the housing 2.

In a state where the drum cartridge 4M is located at the first position and the second drum pressing member 132 is located at the release position, the second drum pressing member 132 releases the pressure on the second side plate 422.

Thus, in a state where the drum cartridge 4M is located at the first position and the first drum pressing member 131 and the second drum pressing member 132 are located at the release position, the second drum pressing member 132, in cooperation with the first drum pressing member 131, releases the pressing of the photosensitive drum 41M toward the transfer device 7. Thus, the upper end of the first side plate 421 is separated from the drum positioning plate 19A, and the upper end of the second side plate 422 is separated from the drum positioning plate 19B. As a result, the photosensitive drum 41M is separated from the intermediate transfer belt 71, and the positioning relative to the housing 2 is released.

4.5 Four Cams 14Y, 14M, 14C, 14K

As shown in FIG. 1, the four cams 14Y, 14M, 14C, and 14K have the same structure as one another. Thus, the cam 14M will be described in detail, and the description of the three cams 14Y, 14C, and 14K will be omitted.

4.5.1 Cam 14M

As shown in FIGS. 2 and 3, in a state where the cover 10 is located at the closed position, the cam 14M causes the first drum pressing member 131 and the second drum pressing member 132 to be located at the pressing position (see FIG. 2). In a state where the cover 10 is located at the open position, the cam 14M causes the first drum pressing member 131 and the second drum pressing member 132 to be located at the release position (see FIG. 3).

As shown in FIG. 1, the cam 14M is located between the leg portion 125A and the leg portion 125B in the rail 12M and below the third wall 123 (see FIG. 1). The cam 14M extends in the first direction. The cam 14M is movable in the first direction in conjunction with movement of the cover 10. The cam 14M is connected to the cover 10 by a connecting member 15M. The connecting member 15M connects the cam 14M and the cover 10. The cam 14M includes a first plate 141 and a second plate 142.

The first plate 141 is located between the drum pressing unit 13M and the leg portion 125A. As shown in FIG. 2, the first plate 141 extends in the first direction. The first plate 141 has the first elongated hole 1411 and the second elongated hole 1412.

The boss 1312A of the first drum pressing member 131 fits in the first elongated hole 1411. In other words, the first plate 141 engages the boss 1312A. The first elongated hole 1411 has one end and an other end in the first direction. The one end of the first elongated hole 1411 in the first direction is located at a higher position than the other end of the first elongated hole 1411 in the first direction. The first elongated hole 1411 is inclined downward from the one end to the other end.

The boss 1322A of the second drum pressing member 132 fits in the second elongated hole 1412. In other words, the first plate 141 engages the boss 1322A. The second elongated hole 1412 is located away from the first elongated hole 1411 in the first direction. The second elongated hole 1412 is described in the same manner as the first elongated hole 1411. Thus, the description of the second elongated hole 1412 will be omitted.

In a state where the cover 10 is located at the closed position and the first drum pressing member 131 and the second drum pressing member 132 are located at the pressing position, the boss 1312A is located at the one end of the first elongated hole 1411 and the boss 1322A is located at the one end of the second elongated hole 1412. In a state where the cover 10 is located at the open position and the first drum pressing member 131 and the second drum pressing member 132 are located at the release position, the boss 1312A is located at the other end of the first elongated hole 1411 and the boss 1322A is located at the other end of the second elongated hole 1412 (see FIG. 3).

As shown in FIG. 1, the second plate 142 is located between the drum pressing unit 13M and the leg portion 125B in the second direction. The second plate 142 is described in the same manner as the first plate 141. Thus, the description of the second plate 142 is omitted.

4.6 Two Development Pressing Members 18A, 18B

As shown in FIG. 2, the two development pressing members 18A and 18B are located at an interval from each other in the first direction. The development pressing member 18A is located between the transfer device 7 and the drum positioning plate 19A in the first direction. The development pressing member 18B is located at the opposite side of the development pressing member 18A with respect to the transfer device 7 in the first direction. The development pressing member 18B is located between the transfer device 7 and the drum positioning plate 19B in the first direction. In a state where the cover 10 is located at the closed position, the development pressing member 18B is located at the opposite side of the cover 10 with respect to the drum positioning plate 19B in the first direction. The two development pressing members 18A and 18B have the same structure as each other. Thus, the development pressing member 18A will be described in detail, and the description of the development pressing member 18B will be omitted.

As shown in FIG. 1, in a state where the drum cartridge 4M is located at the first position and the cover 10 is located at the closed position, the development pressing member 18A presses the development roller 51Y toward the photosensitive drum 41Y, presses the development roller 51M toward the photosensitive drum 41M, presses the development roller 51C toward the photosensitive drum 41C, and presses the development roller 51K toward the photosensitive drum 41K. In a state where the drum cartridge 4M is located at the first position, the development pressing member 18A is located above the four development rollers 51Y, 51M, 51C, and 51K. The development pressing member 18A includes four pressing portions 181Y, 181M, 181C, 181K and a link member 182.

The four pressing portions 181Y, 181M, 181C, and 181K have the same structure as one another. Thus, the pressing portion 181M will be described in detail, and the description of the three pressing portions 181Y, 181C, and 181K will be omitted. In a state where the drum cartridge 4M is located at the first position and the cover 10 is located at the closed position, the pressing portion 181M contacts the pressed portion 524A of the development frame 52M from the opposite side of the photosensitive drum 41M. Thus, the pressing portion 181M presses the pressed portion 524A toward the photosensitive drum 41M. Thus, the development roller 51K is in stable contact with the photosensitive drum 41K.

The link member 182 supports the four pressing portions 181Y, 181M, 181C, and 181K. The link member 182 moves in conjunction with movement of the cover 10. Although not shown, when the cover 10 moves from the closed position to the open position, the link member 182 moves such that the pressing portion 181M moves away from the pressed portion 524A. Thus, in a state where the drum cartridge 4M is located at the first position and the cover 10 is located at the open position, the pressing portion 181M is located away from the pressed portion 524A of the development frame 52M.

4.7 Four Support Portions 16Y, 16M, 16C, 16K

As shown in FIGS. 2 and 3, the four support portions 16Y, 16M, 16C, and 16K have the same structure as one another. Thus, the support portion 16M will be described in detail, and the description of the three support portions 16Y, 16C, and 16K will be omitted.

The support portion 16M moves with the cover 10. The support portion 16M is rotationally connected to the rail 12M.

As shown in FIG. 2, the in a state where the cover 10 is located at the closed position, the support portion 16M is located in the housing 2. In a state where the drum cartridge 4M is located at the first position and the cover 10 is located at the closed position, the support portion 16M extends in the vertical direction and is located between the cover 10 and the second side plate 422.

As shown in FIG. 4, in a state where the cover 10 is located at the open position, at least part of the support portion 16M is located outside the housing 2. In a state where the cover 10 is located at the open position, the support portion 16M extends in the first direction and is continuous with the rail main body 124 of the rail 12M. In a state where the cover 10 is located at the open position and the drum cartridge 4M is located at the second position, the support portion 16M supports the drum cartridge 4M. The support portion 16M includes a main body 161, a hinge 162, a boss 163, and the stopper 164. In other words, the image forming apparatus 1 includes the stopper 164.

The main body 161 has a U-shape that is open upward in a state where the cover 10 is located at the open position. In a state where the cover 10 is located at the open position, the main body 161 extends in the first direction and is continuous with the rail main body 124. In a state where the cover 10 is located at the open position and the drum cartridge 4M is located at the second position, at least part of the contact portion 425 fits in the main body 161. The main body 161 has one end and an other end. The other end of the main body 161 is located away from the one end.

The hinge 162 is located at the one end of the main body 161. The hinge 162 connects the main body 161 with the first wall 121. Thus, the main body 161 is rotationally movable relative to the rail main body 124.

The boss 163 is located at the other end of the main body 161. The boss 163 fits in an elongated hole 1011 of a connecting portion 101M. The connecting portion 101M is provided at the cover 10. In a state where the cover 10 is located at the open position, the connecting portion 101M is located outside the housing 2. In a state where the cover 10 is located at the open position, the elongated hole 1011 extends in the first direction. In a state where the cover 10 is located at the closed position, the connecting portion 101M is located in the housing 2. In a state where the cover 10 is located at the closed position, the elongated hole 1011 extends in the vertical direction.

As shown in FIG. 4, when the drum cartridge 4M is located at the second position and the development cartridge 5M is detached from the drum cartridge 4M, the stopper 164 stops upward movement of the drum cartridge 4M. The stopper 164 is a protrusion that is provided at the main body 161 and substantially extends in the first direction. The direction in which the stopper 164 extends may be parallel to the first direction, or may not be parallel to the first direction and may have an angle of several degrees in a state where the drum cartridge 4M is attached to the housing 2 and the development cartridge 5M is attached to the drum cartridge 4M. In a state where the cover 10 is located at the open position, the stopper 164 protrudes from the main body 161 in a direction crossing the first direction and the vertical direction. In a state where the drum cartridge 4M is located at the second position, the stopper 164 fits in the groove 4255A of the contact portion 425. Thus, in a state where the drum cartridge 4M is located at the second position, the drum cartridge 4M is not movable in the vertical direction. When detaching the drum cartridge 4M from the housing 2, the drum cartridge 4M located at the second position is further moved in the first direction. In this state, the drum cartridge 4M can be detached from the housing 2.

As shown in FIG. 2, in a state where the drum cartridge 4M is located at the first position, the stopper 164 is separated from the groove 4255A. Thus, in a state where the drum cartridge 4M is located at the first position, the drum cartridge 4M is movable relative to the transfer device 7 in the vertical direction.

5. Operations and Effects

In the image forming apparatus 1, when replacing the development cartridge 5M, the drum cartridge 4M first moves from the first position to the second position. Then, after the user visually confirms the development cartridge 5M in a state where at least part of the drum cartridge 4M is located outside the housing 2, the development cartridge 5M is detached from the drum cartridge 4M.

Thus, in a state where the development cartridge 5M and the drum cartridge 4M are located in the housing 2, the user does not need to determine the cartridge to be replaced. As a result, the development cartridge 5M and the drum cartridge 4M can be replaced individually and smoothly.

While the disclosure has been described in detail with reference to the above aspects thereof, it would be apparent to those skilled in the art that various changes and modifications may be made therein without departing from the scope of the claims.

What is claimed is:

1. An image forming apparatus comprising:

a housing having two walls apart from each other in a first direction, one of the two walls having an opening;

a drum cartridge including a photosensitive drum rotatable about a drum axis, the drum axis extending in the first direction in a state where the drum cartridge is attached to the housing, the drum cartridge being movable through the opening between a first position at which an entirety of the drum cartridge is located inside the housing and a second position at which at least part of the drum cartridge is located outside the housing; and a development cartridge including a development roller rotatable about a development roller axis extending in the first direction, the development cartridge being unattachable to and undetachable from the drum cartridge in a state where the drum cartridge is located at the first position, the development cartridge being attachable to and detachable from the drum cartridge in a state where the drum cartridge is located at the second position.

2. The image forming apparatus according to claim 1, further comprising a transfer device configured to transfer toner from the photosensitive drum to a sheet, wherein the drum cartridge is located below the transfer device in a state where the drum cartridge is located at the first position.

3. The image forming apparatus according to claim 2, wherein the transfer device includes:

an intermediate transfer belt to which toner on the photosensitive drum is transferred; and a transfer roller configured to transfer toner on the intermediate transfer belt to the sheet.

4. The image forming apparatus according to claim 1, further comprising a drum guide configured to guide movement of the drum cartridge between the first position and the second position, the drum guide extending in the first direction.

5. The image forming apparatus according to claim 1, wherein the drum cartridge includes:

a first side plate; and a second side plate located away from the first side plate in the first direction; and wherein, in a state where the development cartridge is attached to the drum cartridge, the development cartridge is located between the first side plate and the second side plate in the first direction.

6. The image forming apparatus according to claim 5, wherein the first side plate includes a first guide configured to guide attachment and detachment of the development cartridge relative to the drum cartridge, the first guide extending in a second direction crossing the first direction.

7. The image forming apparatus according to claim 6, wherein the development cartridge includes:

an agitator rotatable about an agitator axis extending in the first direction; and a first boss extending along the agitator axis; and wherein, when the development cartridge is attached to the drum cartridge, the first guide guides the first boss.

8. The image forming apparatus according to claim 5, wherein, in a state where the development cartridge is attached to the drum cartridge, the development cartridge is rotationally movable relative to the drum cartridge.

9. The image forming apparatus according to claim 8, wherein the development cartridge includes an agitator rotatable about an agitator axis extending in the first direction; and wherein, in a state where the development cartridge is attached to the drum cartridge, the development cartridge is rotationally movable about the agitator axis.

10. The image forming apparatus according to claim 9, wherein the development cartridge includes a second boss extending along the development roller axis;

wherein the first side plate includes a second guide configured to guide the second boss when the development cartridge rotationally moves relative to the photosensitive drum; and wherein the second guide extends in an arc shape about the agitator axis as a center.

11. The image forming apparatus according to claim 1, further comprising a development pressing member configured to press the development roller toward the photosensitive drum.

12. The image forming apparatus according to claim 11, wherein, in a state where the drum cartridge is located at the first position, the development pressing member is located above the development roller.

13. The image forming apparatus according to claim 12, wherein the development cartridge includes:

a development frame supporting the development roller; and a pressed portion configured to be pressed by the development pressing member, the pressed portion protruding upward from the development frame.

14. The image forming apparatus according to claim 1, wherein, in a state where the drum cartridge is located at the second position, the development cartridge is detachable upward from the drum cartridge; and wherein the image forming apparatus further comprises a stopper configured to stop upward movement of the drum cartridge when the development cartridge is detached from the drum cartridge in a state where the drum cartridge is located at the second position.

15. The image forming apparatus according to claim 14, further comprising:

a cover movable between a closed position at which the opening is closed and an open position at which the opening is open; and a support portion movable together with the cover, the support portion being configured to:

be located outside the housing in a state where the cover is located at the open position; and support the drum cartridge in a state where the cover is located at the open position and the drum cartridge is located at the second position, wherein the support portion includes the stopper.

16. The image forming apparatus according to claim 14, wherein the drum cartridge includes a contact portion configured to contact the stopper.

17. The image forming apparatus according to claim 16, wherein the stopper is a protrusion extending in the first direction; and wherein the contact portion has a groove in which the protrusion fits.

18. The image forming apparatus according to claim 17, wherein the contact portion includes two walls located away from each other in a particular direction; and wherein each of the two walls has the groove.

19. The image forming apparatus according to claim 18, further comprising an exposure device configured to expose a surface of the photosensitive drum, wherein the two walls extend toward the photosensitive drum in a state where the drum cartridge is located at the first position; and wherein the contact portion has a through hole located between the two walls, wherein light from the exposure device passes through the through hole.

20. The image forming apparatus according to claim 16, further comprising a transfer device configured to transfer toner from the photosensitive drum to a sheet, wherein the drum cartridge is located below the transfer device in a state where the drum cartridge is located at the first position; and wherein the drum cartridge is movable in a vertical direction relative to the transfer device in a state where the drum cartridge is located at the first position.

21. The image forming apparatus according to claim 20, further comprising a first drum pressing member configured to press the photosensitive drum toward the transfer device in a state where the drum cartridge is located at the first position, the first drum pressing member being located at an opposite side of the photosensitive drum with respect to the contact portion.

22. The image forming apparatus according to claim 21, further comprising an exposure device configured to expose a surface of the photosensitive drum, wherein the exposure device has an emitting opening configured to emit light that exposes the photosensitive drum; and wherein the first drum pressing member is located away from the emitting opening in the first direction, and is located between the emitting opening and the photosensitive drum in a vertical direction.

23. The image forming apparatus according to claim 22, further comprising a second drum pressing member configured to press the photosensitive drum toward the transfer device in a state where the drum cartridge is located at the first position, the second drum pressing member being located at an opposite side of the photosensitive drum with respect to the contact portion, wherein the second drum pressing member is located at an opposite side of the first drum pressing member with respect to the emitting opening in the first direction.

24. An image forming apparatus comprising:

a housing having an opening;

a drum cartridge including a photosensitive drum rotatable about a drum axis extending in a first direction, the drum cartridge being movable in the first direction through the opening between a first position at which an entirety of the drum cartridge is located inside the housing and a second position at which at least part of the drum cartridge is located outside the housing; and a development cartridge including a development roller rotatable about a development roller axis extending in the first direction, the development cartridge being unattachable to and undetachable from the drum cartridge in a state where the drum cartridge is located at the first position, the development cartridge being attachable to and detachable from the drum cartridge in a state where the drum cartridge is located at the second position.

* * * * *